US010089813B2

(12) United States Patent
Kawamoto et al.

(10) Patent No.: US 10,089,813 B2
(45) Date of Patent: Oct. 2, 2018

(54) BILL PROCESSING DEVICE

(71) Applicant: FUJI ELECTRIC CO., LTD., Kawasaki-shi, Kanagawa (JP)

(72) Inventors: Masayoshi Kawamoto, Yokkaichi (JP); Toshinori Hemmi, Yokkaichi (JP); Toshinori Shigeyama, Mie-gun (JP); Masao Nakayama, Yokkaichi (JP); Masayuki Higashi, Yokkaichi (JP)

(73) Assignee: FUJI ELECTRIC CO., LTD., Kawasaki (JP)

( * ) Notice: Subject to any disclaimer, the term of this patent is extended or adjusted under 35 U.S.C. 154(b) by 11 days.

(21) Appl. No.: 15/660,108

(22) Filed: Jul. 26, 2017

(65) Prior Publication Data

US 2018/0047240 A1 Feb. 15, 2018

(30) Foreign Application Priority Data

Aug. 9, 2016 (JP) ..... 2016-156529
Sep. 16, 2016 (JP) ..... 2016-181909

(51) Int. Cl.
*G07F 7/04* (2006.01)
*G07D 11/00* (2006.01)
(Continued)

(52) U.S. Cl.
CPC ..... *G07D 11/0084* (2013.01); *G07D 1/02* (2013.01); *G07D 7/20* (2013.01); *G07D 11/006* (2013.01); *G07D 11/0006* (2013.01); *G07D 11/0021* (2013.01); *G07D 11/0051* (2013.01); *G07D 11/0054* (2013.01); *G07D 11/0057* (2013.01);
(Continued)

(58) Field of Classification Search
CPC ..... G07D 11/00; G07D 11/0003; G07D 11/0006; G07D 11/0009; G07D 11/0012; G07D 11/0015; G07D 11/0021; G07D 11/0033; G07D 11/0057; G07D 11/006; G07D 11/0081; G07D 11/0084;
(Continued)

(56) References Cited

U.S. PATENT DOCUMENTS

2005/0189266 A1* 9/2005 Fujita ..... G07D 11/0081 209/534
2007/0062782 A1* 3/2007 Yoshikawa ..... G07D 11/0081 194/206
2009/0211874 A1* 8/2009 Oie ..... B65H 3/44 194/206

FOREIGN PATENT DOCUMENTS

JP 2011-65417 3/2011
JP 2015-156141 8/2015
JP 2015-170341 9/2015

* cited by examiner

*Primary Examiner* — Jeffrey A Shapiro

(57) ABSTRACT

A bill processing device includes: a first denomination bill storage box configured to store therein first denomination bills to be used as change; a mix box configured to store therein a plurality of denominations of bills other than the first denomination bills in a mixed manner; and an examination box configured to function as a temporary storage box in examination of recounting numbers of bills stored in the first denomination bill storage box and the mix box, the bill processing device being configured to perform reception and dispensing processing of bills. Only second denomination bills to be used as change are stored in the examination box or the mix box in the reception or after the examination, and the second denomination bills stored in the examination box or the mix box are dispensed when a dispensing instruction to dispense the second denomination bills is given.

7 Claims, 15 Drawing Sheets

(51) Int. Cl.
*G07D 1/02* (2006.01)
*G07D 7/20* (2016.01)

(52) U.S. Cl.
CPC ..... *G07D 2207/00* (2013.01); *G07D 2211/00* (2013.01)

(58) Field of Classification Search
CPC .. G07D 7/20; G07D 2207/00; G07D 2211/00; G07D 11/0051; G07D 11/0054; G07D 11/0087
USPC ..... 194/206, 207; 209/534; 235/379
See application file for complete search history.

BILL PROCESSING DEVICE

CROSS-REFERENCE TO RELATED APPLICATION(S)

The present application claims priority to and incorporates by reference the entire contents of Japanese Patent Application No. 2016-156529 filed in Japan on Aug. 9, 2016, and Japanese Patent Application No. 2016-181909 filed in Japan on Sep. 16, 2016.

BACKGROUND

1. Technical Field

The disclosure relates to a bill processing device.

2. Related Art

Automatic change machines are installed in stores such as supermarkets and convenience stores for customer operation and strict cash management. A point of sales (POS) register device and the like are connected to the automatic change machine and the POS register device instructs the automatic change machine to perform reception and dispensing processing of cash such as coins and bills. The reception and dispensing processing also includes change processing.

A bill processing device that is applied as a bill change machine conveys bills input through a reception unit formed in a device main body to a predetermined conveyance path and causes a discrimination unit to discriminate the authenticity of the bills that are conveyed in the conveyance path. The bill processing device separates the bills that have been discriminated to be "genuine" by the above-mentioned discrimination unit from the conveyance path and stores them in a predetermined storage box. In the bill processing device, when a dispensing instruction is given, the bills sent from the predetermined storage box are conveyed to a dispensing box through the above-mentioned conveyance path and are dispensed from the device main body (for example, see Japanese Patent Application Laid-open No. 2011-65417).

The automatic change machine normally includes, for the purpose of space saving, three storage boxes of a one thousand-yen bill storage box storing no therein one thousand-yen bills, a mix box storing therein a plurality of denominations of bills other than the one thousand-yen bills in a mixed manner, and an examination box as a temporal storage box in examination of recounting the number of bills stored in the one thousand-yen bill storage box and the mix box.

Japanese Patent Application Laid-open No. 2015-156141 discloses a cash processing device that recounts stored money using an examination box capable of transferring money to and from other storage boxes.

Furthermore, Japanese Patent Application Laid-open No. 2015-170341 discloses a bill change machine including a plurality of bill storage units storing therein bills sent from a conveyance unit and capable of feeding out the stored bills to the conveyance unit and an auxiliary storage unit storing therein the bills sent from the conveyance unit and capable of feeding out the stored bills to the conveyance unit. This bill change machine performs examination processing of returning the bills stored in the respective bill storage units to the respective bill storage units by the conveyance unit and identifying, by an identification unit, the bills that are conveyed by the conveyance unit during the return.

SUMMARY

The bill processing device including only three storage boxes of the one thousand-yen bill storage box, the mix box, and the examination box as described above has a difficulty in storing the bills for the respective denominations. Furthermore, the plurality of denominations of bills other than the one thousand-yen bills are randomly stored in the mix box.

The bill processing device therefore has the problem that when a five thousand-yen bill is dispensed as change, a time required for dispensing is increased because ten thousand-yen bills, five thousand-yen bills, and two thousand-yen bills are stored in the mix box in a mixed manner.

It is an object of the disclosure to at least partially solve the problems in the conventional technology.

In some embodiments, a bill processing device includes: a first denomination bill storage box configured to store therein first denomination bills to be used as change; a mix box configured to store therein a plurality of denominations of bills other than the first denomination bills in a mixed manner; and an examination box configured to function as a temporary storage box in examination of recounting numbers of bills stored in the first denomination bill storage box and the mix box, the bill processing device being configured to perform reception and dispensing processing of bills. Only second denomination bills to be used as change are stored in the examination box or the mix box in the reception or after the examination, and the second denomination bills stored in the examination box or the mix box are dispensed when a dispensing instruction to dispense the second denomination bills is given.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

Hereinafter, a mode for carrying out the disclosure will be described with reference to the accompanying drawings.

First Embodiment

Configuration of Cash Processing Device

Figure 1:
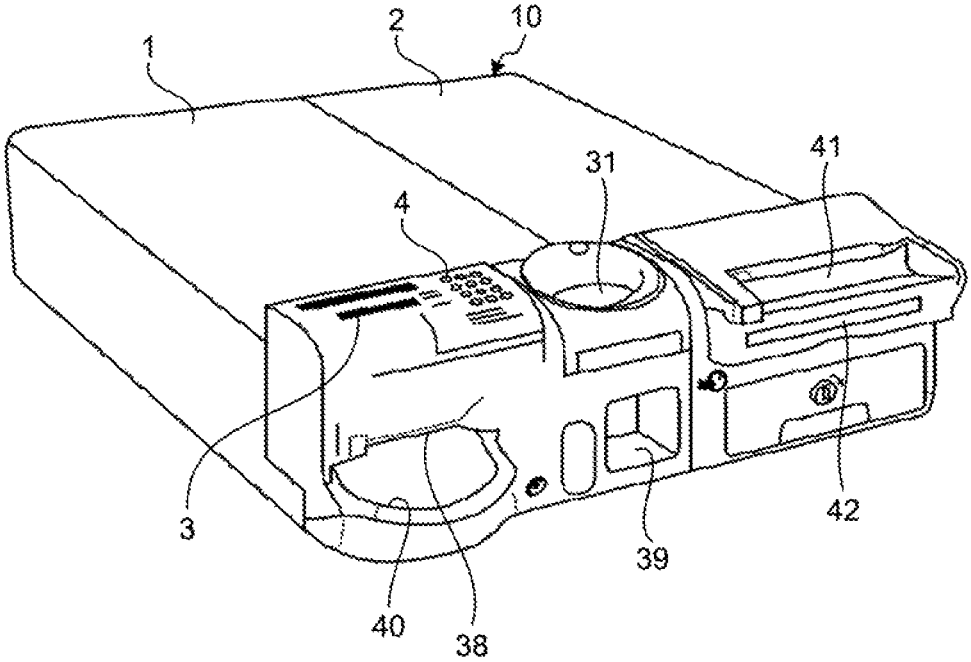
FIG. 1 is a perspective view illustrating the configuration of a cash processing device including a bill processing device as a first embodiment of the disclosure.
Figure 2:
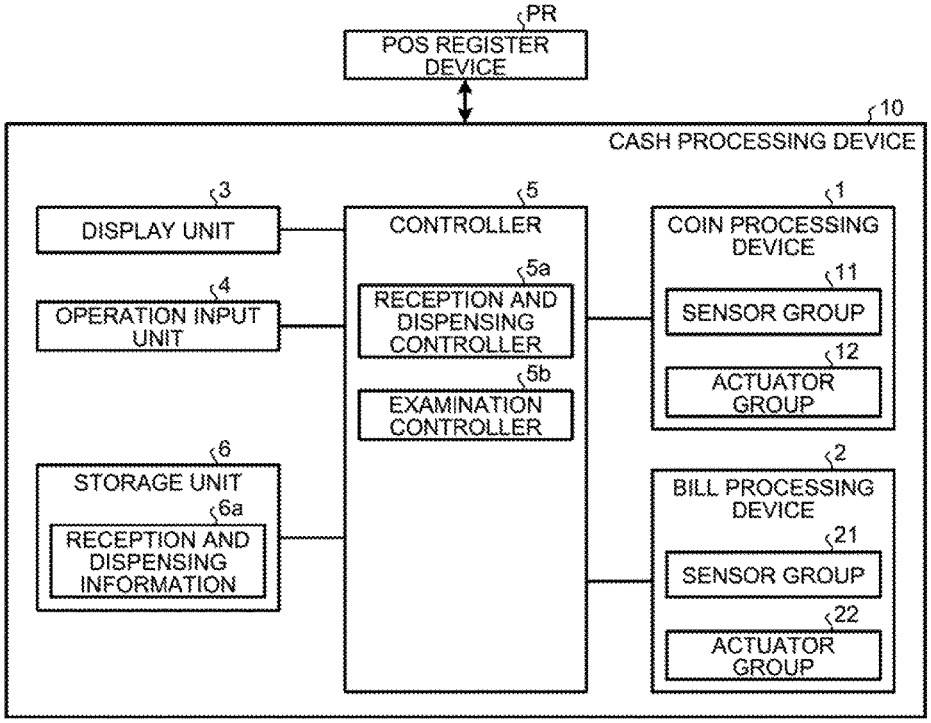
FIG. 2 is a block diagram illustrating the configuration of a control system of the cash processing device.

FIG. 1 is a perspective view illustrating the configuration of a cash processing device 10 including a bill processing device as a first embodiment of the disclosure. FIG. 2 is a block diagram illustrating the configuration of a control system of the cash processing device 10. The cash processing device 10 as is described herein is used as an automatic change machine that is connected to a POS register device PR in stores such as supermarkets and convenience stores. As illustrated in FIG. 1 and FIG. 2, the upper surface of the cash processing device 10 is formed as a flat surface and the POS register device PR as a high-order device is arranged on the flat surface. The cash processing device 10 includes a coin processing device 1 that receives and dispenses coins and a bill processing device 2 that receives and dispenses bills. The coin processing device 1 and the bill processing device 2 are covered by a device main body having a rectangular parallelepiped shape and are arranged in an adjacent manner.

The coin processing device 1 includes a coin slot 31 at the front end right side on the upper surface of the device main body. A coin dispensing port 38 is formed at the left side on the front surface of the device main body of the coin processing device 1 and coins discharged through the coin dispensing port 38 are received by a reception tray 40. In addition, a coin return port 39 is provided at the right side on the front surface of the device main body. A bill slot 41 and a bill dispensing port 42 are provided on a front surface upper portion of the device main body of the bill processing device 2.

The coin processing device 1 includes a display unit 3 and an operation input unit 4 at the front end left side on the upper surface of the device main body. The display unit 3 and the operation input unit 4 also serve as a display unit and an operation input unit of the bill processing device 2. A controller 5 and a storage unit 6 are provided in the cash processing device 10.

The coin processing device 1 includes a sensor group 11 and an actuator group 12. The bill processing device 2 includes a sensor group 21 and an actuator group 22.

The controller 5 includes a reception and dispensing controller 5*a*. The reception and dispensing controller 5*a* performs money reception processing in accordance with a reception permission instruction when money is input after the POS register device PR gives the reception permission instruction, and performs money dispensing processing in accordance with a dispensing instruction when the POS register device PR gives the dispensing instruction. The reception and dispensing controller 5*a* also performs processing of successively storing, in the storage unit 6, contents of the executed reception processing and dispensing processing as reception and dispensing information 6*a* while executing the reception processing and dispensing processing.

The controller 5 includes an examination controller 5*b*. In examination in accordance with an examination instruction, the examination controller 5*b* performs first examination processing of emptying an examination box 52 (see FIG. 3), conveying, to the examination box 52, one thousand-yen bills as first denomination bills stored in a one thousand-yen bill storage box 53 (see FIG. 3) as a first denomination bill storage box while counting them to temporarily store them in the examination box 52, and returning the one thousand-yen bills temporarily stored in the examination box 51 to the one thousand-yen bill storage box 53, and second examination processing of conveying, to the examination box 52, bills stored in a mix box 54 (see FIG. 3) while counting them to temporarily store them in the examination box 52, returning, to the mix box 54, five thousand-yen bills as second denomination bills to be used as change among the bills temporarily stored in the examination box 52 and temporarily storing, in the one thousand-yen bill storage box 53, bills other than the five thousand-yen bills in the examination box 52, and conveying and storing, to and in the examination box 52, bills other than the one thousand-yen bills that are stored in the one thousand-yen bill storage box 53.

Internal Configuration of Bill Processing Device

Figure 3:
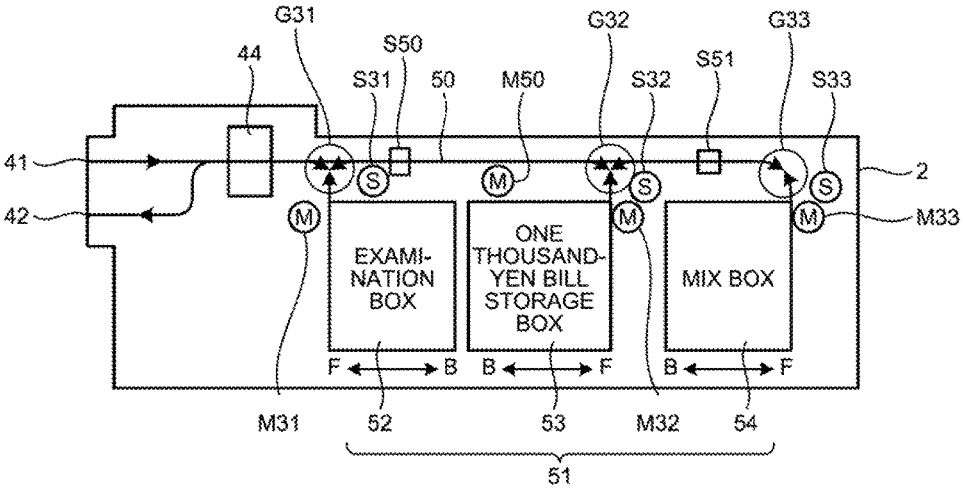
FIG. 3 is a side view conceptually illustrating the internal configuration of the bill processing device illustrated in FIG. 1.

FIG. 3 is a side view conceptually illustrating the internal configuration of the bill processing device 2 illustrated in FIG. 1. As illustrated in FIG. 3, in the bill processing device 2, bills that are conveyed through the bill slot 41 are discriminated by a bill discrimination sensor 44, and then, stored in the examination box 52, the one thousand-yen bill storage box 53, or the mix box 54 in the bill storage box 51 in accordance with denominations thereof. The examination box 52 stores therein bills other than the one thousand-yen bills and the five thousand-yen bills, for example, ten thousand-yen bills, two thousand-yen bills, and old bills. That is to say, the examination box 52 is used as a temporal storage box in the examination and stores therein bills that are not used as change. The one thousand-yen bill storage box 53 stores therein the one thousand-yen bills. The mix box 54 stores therein the five thousand-yen bills. The bill dispensing port 42 is an opening for discharging, to the outside of the device main body, the bills conveyed out from the one thousand-yen bill storage box 53 and the mix box 54 and is provided in a front surface lower portion of the device main body.

It should be noted that the bills are stored in the examination box 52 from the front side (left side in FIG. 3) to the rear side (right side in FIG. 3). By contrast, the bills are stored in order in the one thousand-yen bill storage box 53 and the mix box 54 from the rear side to the front side. In FIG. 3, reference numerals B denote the back side (storage back row side) at which the bills are aligned first in storage and reference numerals F denote the near side (storage front row side) from which the bills are discharged first in discharging.

A bill conveyance path 50 is arranged between the one thousand-yen bill storage box 53 and the examination box 52 and between the mix box 54 and the examination box 52. On the bill conveyance path 50, a switching gate G31 is arranged at an entrance to the examination box 52, a switching gate G32 is arranged at an entrance to the one thousand-yen bill storage box 53, and a switching gate G33 is arranged at an entrance to the mix box 54. Sensors S31, S32, and 333 as image sensors for detecting passage of the bills are arranged in the vicinities of the switching gates G31, G32, and G33, respectively. Motors M31, M32, M33 for feeding out the bills to the bill conveyance path 50 from the examination box 52, the one thousand-yen bill storage box 53, and the mix box 54, respectively, are provided. A motor M50 for conveying and driving the bill conveyance path 50 is provided. Sensors S50 and S51 as image sensors for detecting denominations and passage of the bills that are conveyed are arranged on the bill conveyance path 50.

Processing of Rearranging Change Bills for Respective Denominations

Processing of rearranging change bills for the respective denominations in the examination by the examination controller 5*b* will be described with reference to flow illustrated in FIG. 4. First, as illustrated in (a) of FIG. 4, the examination controller 5*b* empties the examination box 52. In this processing, when the bills are present in the examination box 52, the examination controller 5*b* conveys and stores one thousand-yen bills 61 to and in the one thousand-yen bill storage box 53 and conveys and stores the bills other than the one thousand-yen bills 61 to and in the mix box 54. In this state, the examination controller 5*b* conveys the one thousand-yen bills 61 stared in the one thousand-yen bill storage box 53 to the examination box 52 while counting them to temporarily store them in the examination box 52. In this case, defective bills are conveyed to the bill dispensing port 42.

Figure 4:
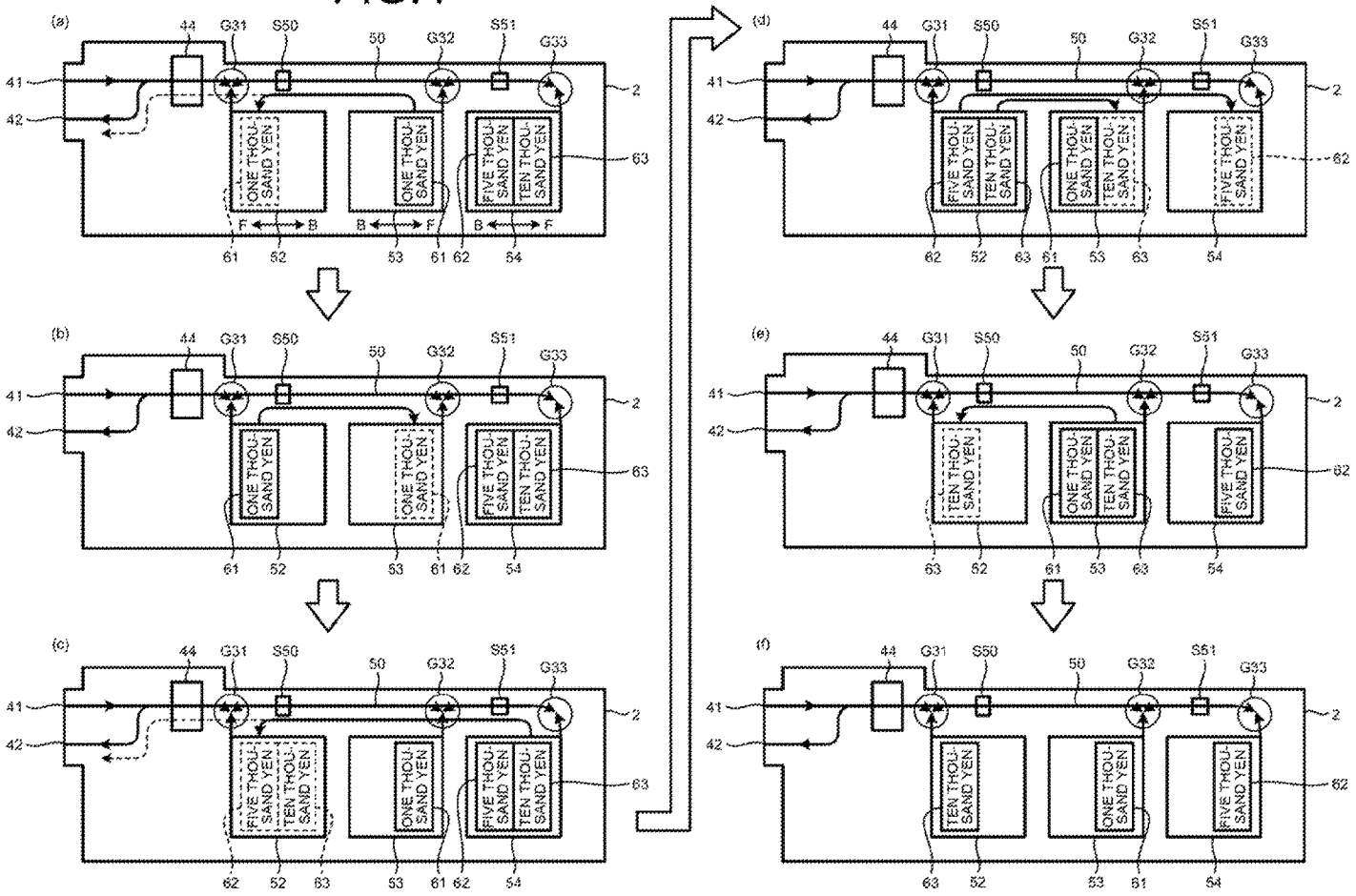
FIG. 4 is a view illustrating flow of processing ox rearranging change bills for respective denominations in examination by an examination controller.

Thereafter, the examination controller 5*b* returns the one thousand-yen bills 61 stored in the examination box 52 to the one thousand-yen bill storage box 53, as illustrated in (b) of FIG. 4. The pieces of processing in (a) of FIG. 4 and (b) of FIG. 4 correspond to the first examination processing.

Subsequently, the examination controller 5*b* conveys the bills stored in the mix box 54 to the examination box 52 while counting them to temporarily store them in the examination box 52, as illustrated in (c) of FIG. 4. In this case, defective bills are conveyed to the bill dispensing port 42. Thereafter, the examination controller 5*b* returns five thousand-yen bills 62 to the mix box 54 and temporarily store the bills other than the five thousand-yen bills 62 (ten thousand-yen bills 63 in this example) in the one thousand-yen bill storage box 53 among the bills stored in the examination box 52, as illustrated in (d) of FIG. 4. Then, the ten thousand-yen bills 63 temporarily stored in the one thousand-yen bill storage box 53 are stored in the examination box 52, as illustrated in (e) of FIG. 4. The pieces of processing in (c), (d), and (e) of FIG. 4 correspond to the second examination processing.

As a result, as illustrated in (f) of FIG. 4, the ten thousand-yen bills 63 other than the one thousand-yen bills 61 and the five thousand-yen bills 62 are stored in the examination box 52, the one thousand-yen bills 61 are stored in the one thousand-yen bill storage box 53, and the five thousand-yen bills 62 are stored in the mix box 54. That is to say, the one thousand-yen bills 61 and the five thousand-yen bills 62 as the change bills are rearranged for the respective denominations in the examination. In particular, when the five thousand-yen bill 62 is used as change, it can be dispensed rapidly.

Processing of Rearranging Change Bills for Respective Denominations and Processing of Switching Change Bills at Storage Back Row Side and Change Bills at Storage Front Row Side Processing of rearranging the change bills for the respective denominations and processing of switching the change bills at the storage back row side and those at the storage front row side in the examination by the examination controller 5*b* will be described with reference to flow illustrated in FIG. 5. First, as illustrated in (a) of FIG. 5, the examination controller 5*b* empties the examination box 52. In this processing, when the bills are present in the examination box 52, the examination controller 5*b* conveys and stores the one thousand-yen bills 61 to and in the one thousand-yen bill storage box 53 and conveys and stores the bills other than the one thousand-yen bills 61 to and in the mix box 54. In this state, the examination controller 5*b* conveys the one thousand-yen bills 61 stored in the one thousand-yen bill storage box 53 to the examination box 52 while counting them to temporarily store them in the examination box 52. In this case, one thousand-yen bills 61B at the storage back row aide in the one thousand-yen bill storage box 53 are arranged at the storage front row side in the examination box 52. It should be noted that defective bills are conveyed to the bill dispensing port 42.

Figure 5:
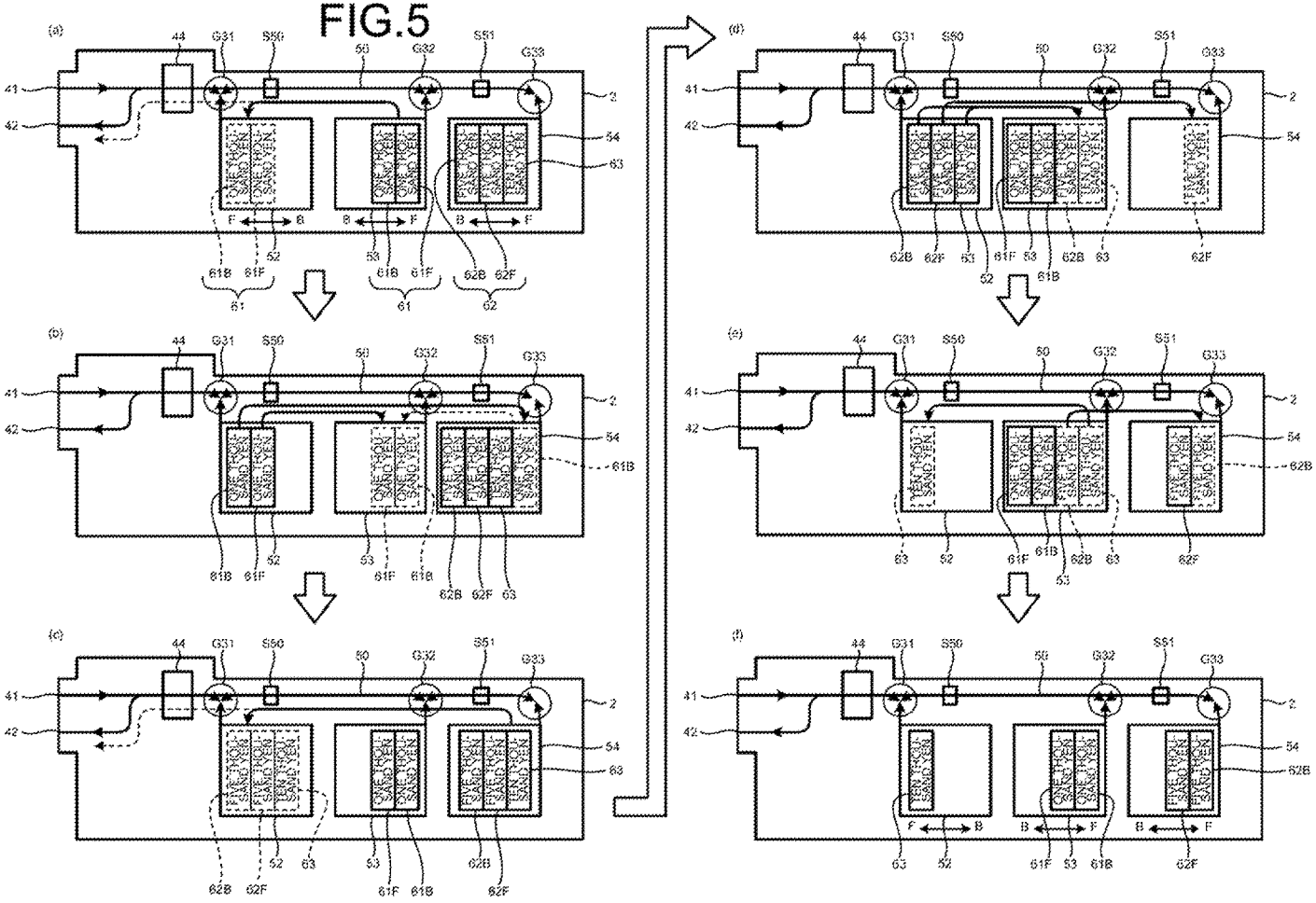
FIG. 5 is a view illustrating flow of the processing of rearranging the change bills for the respective denominations and processing of switching the change bills at the storage back row side and those at the storage front row side in the examination by the examination controller.

Thereafter, the examination controller 5*b* conveys and temporarily stores the predetermined number of one thousand-yen bills 61B at the storage back row side among the one thousand-yen bills 61 stored in the examination box 52 to and in the mix box 54 and returns remaining one thousand-yen bills 61F at the storage front row side in the examination box 52 to the one thousand-yen bill storage box 53, as illustrated in (b) of FIG. 5. Furthermore, the examination controller 5*b* conveys and stores the one thousand-yen bills 61B at the storage back row side that are temporarily stored in the mix box 54 to and in the one thousand-yen bill storage box 53. In this manner, the one thousand-yen bills 61B at the storage back row side and the one thousand-yen bills 61F at the storage front row side are switched in the first examination processing.

Subsequently, the examination controller 5*b* conveys the bills stored in the mix box 54 to the examination box 52 while counting them to temporarily store them in the examination box 52, as illustrated in (c) of FIG. 5. In this case, defective bills are conveyed to the bill dispensing port 42. Thereafter, the examination controller 5*b* conveys and temporarily stores the predetermined number of five thousand-yen bills 62B at the storage back row side and ten thousand-yen bills 63 among the bills stored in the examination box 52 to and in the one thousand-yen bill storage box 53 and returns remaining five thousand-yen bills 62F at the storage front row side in the examination box 52 to the mix box 54, as illustrated in (d) of FIG. 5. Then, the ten thousand-yen bills 53 temporarily stored in the one thousand-yen bill storage box 53 are stored in the examination box 52 and the five thousand-yen bills 62B at the storage back row side are conveyed to and stored in the mix box 54, as illustrated in (e) of FIG. 5. In this manner, the five thousand-yen bills 62B at the storage back row side and the five thousand-yen bills 62F at the storage front row side are switched in the second examination processing.

As a result, as illustrated in (f) of FIG. 5, the ten thousand-yen bills 63 other than the one thousand-yen bills 61 and the five thousand-yen bills 62 are stored in the examination box 52, the one thousand-yen bills 61 are stored in the one thousand-yen bill storage box 53, and the five thousand-yen bills 62 are stored in the mix box 54. That is to say, the one thousand-yen bills 61 and the five thousand-yen bills 62 as the change bills are rearranged for the respective denominations in the examination. In particular, when the five thousand-yen bill 62 is used as change, it can be dispensed rapidly.

The bills at the storage back row side that have fewer opportunities to be dispensed as change remain in the bill processing device and are worn at every examination processing to be easily damaged. To cope with this problem, the one thousand-yen bills 61 and the five thousand-yen bills 62 at the storage back row sides and the storage front row sides are switched. They are therefore easy to be dispensed and the numbers of repeat times of examination processing thereon are reduced, thereby preventing the bills from being worn and damaged.

When the two thousand-yen bills as third denomination bills mixed in the ten thousand-yen bills 63 are used as change, it is sufficient that the same pieces of processing as those on the five thousand-yen bills 62 in (d) and (e) of FIG. 4 or (d) and (e) of FIG. 5 are repeated. As a result of this, in FIG. 4, the five thousand-yen bills S2 and the two thousand-yen bills are stored for the respective denominations in the mix box 54 in (d) of FIG. 4. In FIG. 5, the five thousand-yen bills 62 and the two thousand-yen bills are stored in the mix box 54 in (d) of FIG. 5 while those at the storage front row sides and those at the storage back row sides are switched. It is preferable that the two thousand-yen bills be stored in the examination box 52 because they are not used as change normally. The old bills are also preferably mixed and stored in the examination box 52 in the same manner as the two thousand-yen bills.

In the first embodiment, the examination box 52 may be used as the mix box 54 whereas the mix box 54 may be used as the examination box 52. In this case, after the examination, only the five thousand-yen bills 62 as the second denomination bills are stored in the examination box 52.

Second Embodiment

Figure 6:
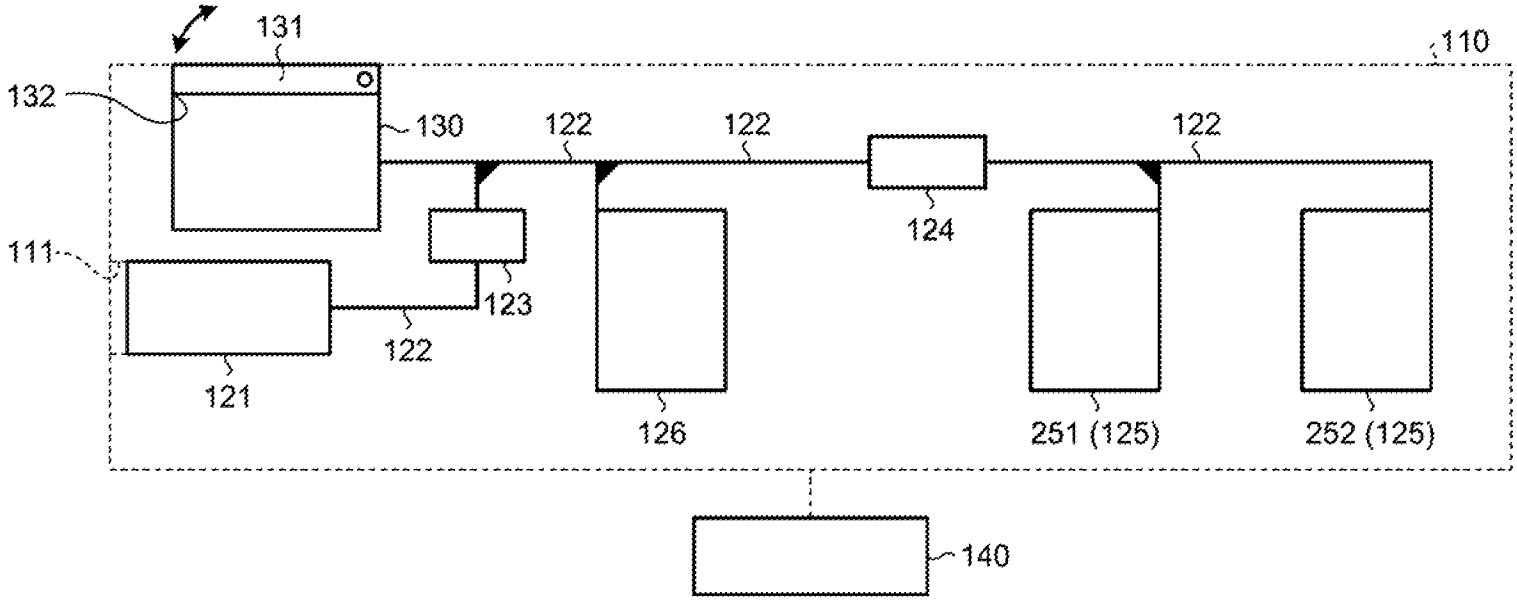
FIG. 6 is a descriptive view schematically illustrating a bill processing device as a second embodiment of the disclosure.

FIG. 6 is a descriptive view schematically illustrating a bill processing device as a second embodiment of the disclosure. The bill processing device that is described herein is applied as, for example, a bill change machine, and includes a device main body 110.

A reception unit 121, a conveyance path 122, a discrimination unit 123, a determination unit 124, storage boxes 125, an examination box 126, and a dispensing collection box (dispensing box) 130 are provided in the device main body 110.

The reception unit 121 is provided so as to communicate with a reception port 111 formed in the device main body 110. The reception port 111 is an opening that is opened and closed by a reception door (not illustrated). The reception unit 121 feeds out, to the conveyance path 122, bills input thereinto through the reception port 111.

The conveyance path 122 extends along the front-rear direction in the device main body 110. The conveyance path 122 is a path that is configured by a conveyance unit including a right and left pair of conveyance belts stretched around a plurality of conveyance pulleys although not illustrated, and conveys bills to the back side from the front side, and to the front side from the back side.

The discrimination unit 123 is provided at a halfway position on the conveyance path 122. The discrimination unit 123 is conventionally known and discriminates the authenticity and denominations of the bills fed out to the conveyance path 122 from the reception unit 121. The discrimination results by the discrimination unit 123 are given as discrimination signals to a controller (control unit) 140.

The controller 140 comprehensively controls operations of the bill processing device in accordance with a computer program and data stored in a memory (not illustrated). The controller 140 may be implemented by causing a processing device such as a central processing unit (CPU) to execute the computer program, that is, by software, hardware such as an integrated circuit (IC), or software and hardware in combination. The controller 140 is illustrated as if it is provided at the outside of the device main body 110 for the convenience but it is provided in the device main body 110 practically.

The determination unit 124 is provided at a halfway position on the conveyance path 122 at the back side relative to the discrimination unit 123. The determination unit 124 is conventionally known and determines the denomination and the number of bills that pass therethrough. The determination results by the determination unit 124 are given as determination signals to the controller 140.

The storage boxes 125 are provided at the back side relative to the determination unit 124. These storage boxes 125 store therein the bills the denominations of which are assigned to them on the basis of the discrimination results by the discrimination unit 123 and feed out the stored bills to the conveyance path 122 on the basis of an instruction given from the controller 140.

In the second embodiment, a front-side storage box 251 stores therein a predetermined denomination of bills (to be specific, one thousand-yen bills) and a back-side storage box 252 stores therein a plurality of denominations of bills (to be specific, ten thousand-yen bills and two thousand-yen bills). The one thousand-yen bill corresponds to the first denomination bill in the first embodiment. The two thousand-yen bill corresponds to the third denomination bill in the first embodiment.

The examination box 126 is provided at the front side relative to the determination unit 124. The examination box 126 stores therein bills and feeds out the stored bills to the conveyance path 122.

The dispensing collection box 130 is provided at the front side of the device main body 110 and is provided above the reception unit 121 in a detachable manner. The dispensing collection box 130 has a dispensing port 132 that is opened and closed by a dispensing door 131. That is to say, the dispensing collection box 130 is provided such that the dispensing door 131 is exposed to the outside of the device main body 110. When the dispensing door 131 swings so as to be opened, the dispensing port 132 is opened and the inside of the dispensing collection box 130 is exposed to the outside of the device main body 110. The dispensing collection box 130 stores therein the bills conveyed through the conveyance path 122 and causes the stored bills to be taken out to the outside through the dispensing port 132.

Although the dispensing collection box 130 is provided in the device main body 110 in a detachable manner, the dispensing collection box 130 cannot be detached from the device main body 110 without an exclusive input operation or insertion and operation of a takeout key (not illustrated) into a predetermined takeout key hole (not illustrated) when it is provided in the device main body 110 as illustrated in FIG. 6. That is to say, the dispensing collection box 130 is provided so as not to be easily detached from the device main body 110.

When the dispensing collection box 130 is provided in the device main body 110, the dispensing door 131 swings so as to be opened and closed in accordance with an instruction from the controller 140. When the dispensing collection box 130 is detached from the device main body 110, the dispensing door 131 closes the dispensing port 132 all the time. The dispensing door 131 can swing so as to be opened only by insertion and operation of a release key (not illustrated) into a predetermined release key hole (not illustrated) to release a state in which the dispensing port 132 is closed.

Operations of the bill processing device having the above-mentioned configuration will be described. First, a reception operation is described.

Figure 7:
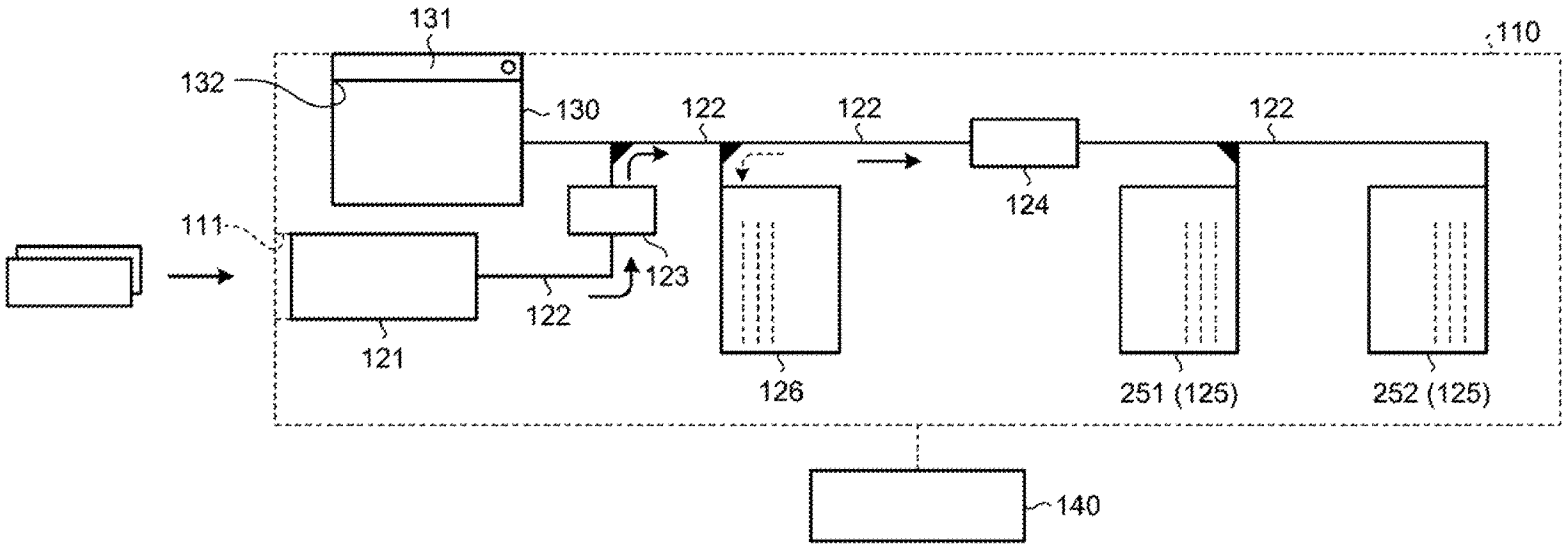
FIG. 7 is a descriptive view for explaining the case in which the bill, processing device illustrated in FIG. 6 performs a reception operation.

When the bill is input into the reception unit 121 through the reception port 111 and a user performs an input operation on an input unit (not illustrated) to give a reception instruction, as illustrated in FIG. 7, the bill processing device feeds out the bill input into the reception unit 121 to the conveyance path 122 for conveyance by the controller 140 driving the conveyance unit including the conveyance pulleys. The bill processing device that has conveyed the bill through the conveyance path 122 causes the discrimination unit 123 to discriminate the authenticity and denomination of the bill being conveyed during the conveyance.

When the discrimination unit 123 discriminates that the bill is "genuine" and discriminates the denomination thereof, the bill processing device causes the controller 140 to convey and store the discriminated bill to and in the predetermined storage box 125 designated for each denomination through the conveyance path 122. As will be described more in detail, the bill processing device stores the bill in the front-side storage box 251 when the discriminated bill is the one thousand-yen bill and stores the bill in the back-side storage box 252 when the discriminated bill is the ten thousand-yen bill or the two thousand-yen bill. When the discriminated bill belongs to a predetermined specific denomination (to be specific, the five thousand-yen bill), it is conveyed to and stored in the examination box 126. The five thousand-yen bill corresponds to the second denomination bill in the first embodiment.

Figure 8:
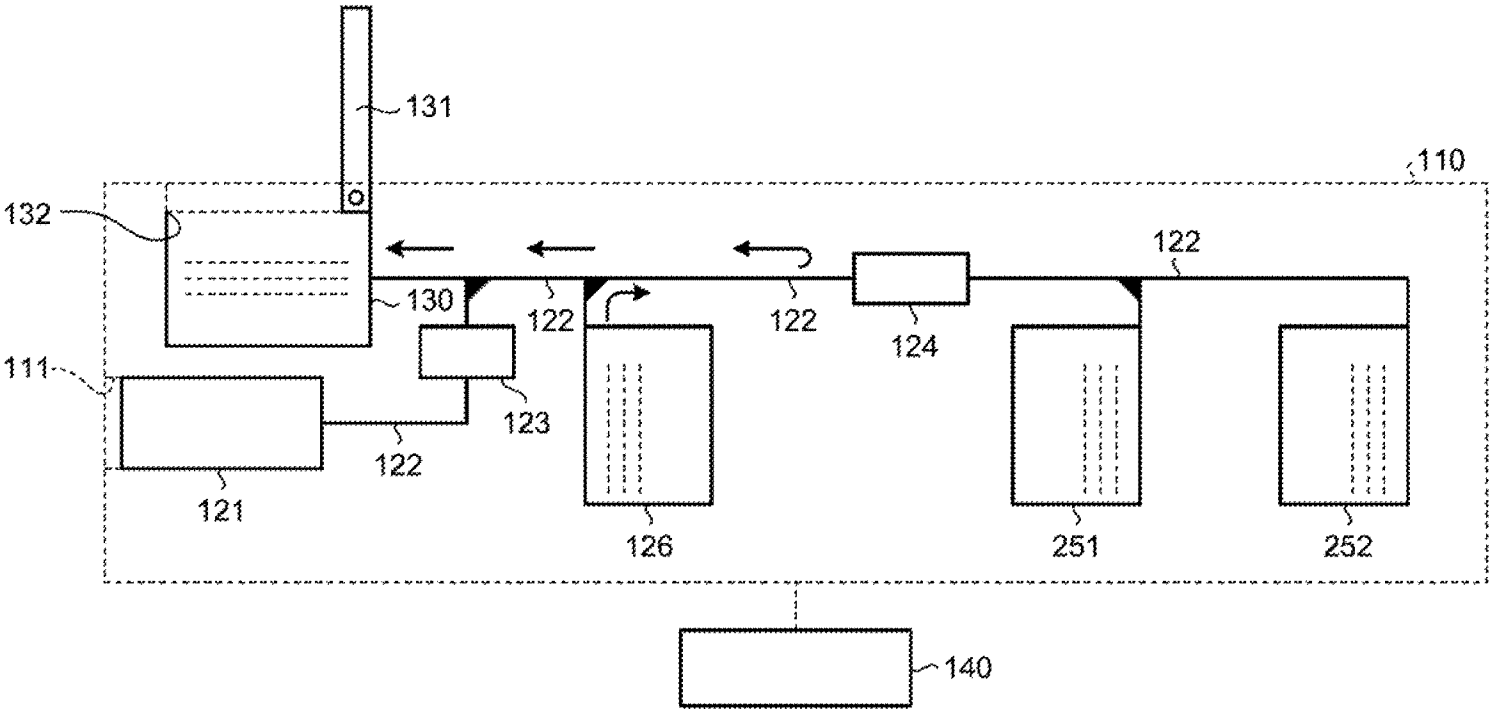
FIG. 8 is a descriptive view for explaining the case in which the bill processing device illustrated in FIG. 6 performs a dispensing operation.

Next, a dispensing operation is described. When the user performs an input operation on the input unit to give a dispensing instruction, the bill processing device feeds out the bill(s) stored in the storage box 125 (front-side storage box 251 or the back-side storage box 252) or the examination box 126 to the conveyance path 122 for conveyance by the controller 140 driving the conveyance unit. When a dispensing instruction to dispense the bill(s) (five thousand-yen bill(s)) stored in the examination box 126 is given, as illustrated in FIG. 8, the bill processing device feeds out the bill(s) stored in the examination box 126 to the conveyance path 122 and determines, by the determination unit 124, the denomination and the number of bills being conveyed during conveyance of the five thousand-yen bill(s) to the front side through the conveyance path 222.

After the determination unit 124 determines the denomination and the like, the bill processing device conveys and stores the determined bill(s) (five thousand-yen bill(s)). to the dispensing collection box 130 through the conveyance path 122. When the predetermined number of bills are thus stored in the dispensing collection box 130 and dispensing preparation is completed, the bill processing device causes the controller 140 to control the dispensing door 131 such that the dispensing door 131 swings so as be opened and opens the dispensing port 132. In this manner, the bills stored in the dispensing collection box 130 can be dispensed so as to be taken out.

Figure 9:
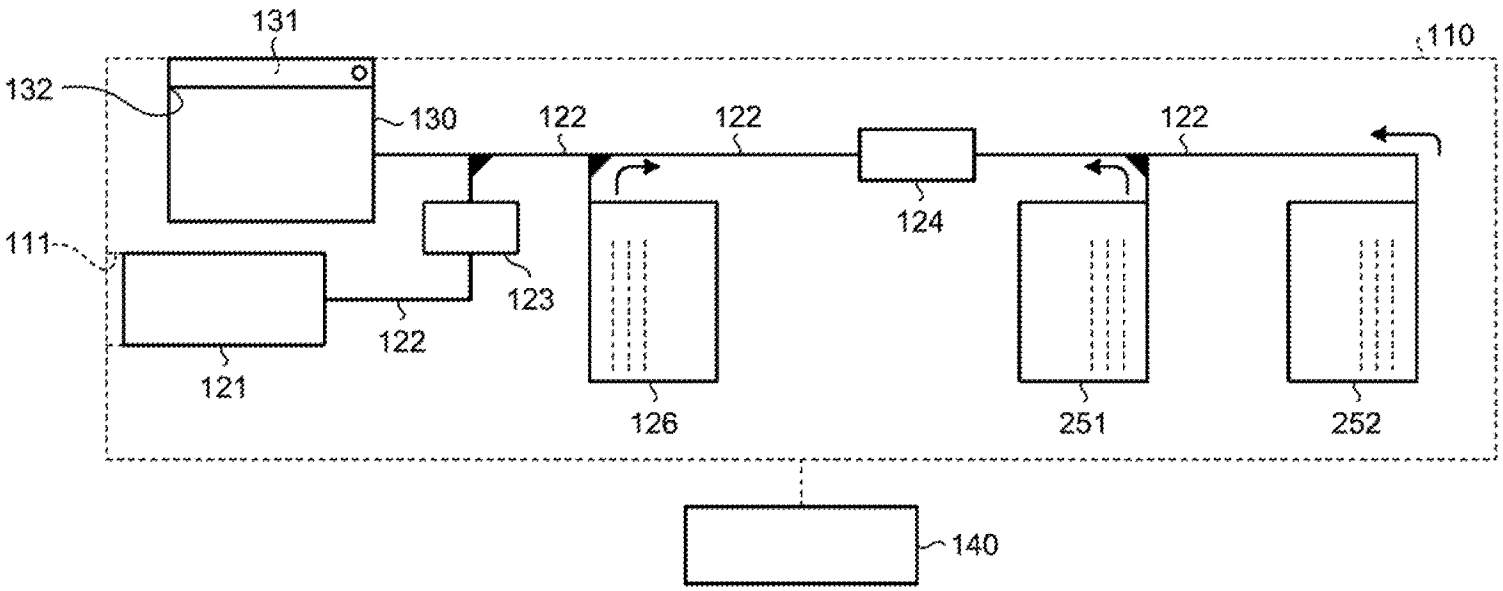
FIG. 9 is a descriptive view for explaining the case in which the bill processing device illustrated in FIG. 6 performs a collection operation.

Next, a collection operation is described. When a manager or the like performs an input operation on an input unit for a manager to give a collection instruction, as illustrated in FIG. 9, the bill processing device feeds out the bills stored in all or the storage boxes 125 and the examination box 126 to the conveyance path 122 and conveys them to the front side through the conveyance path 122 by the controller 140 driving the conveyance unit, and stores them in the dispensing collection box 130. In the dispensing collection box 130, the dispensing door 131 closes the dispensing port 132 all the time with an instruction given from the controller 140 and the closed state can be released only by insertion and operation of the release key into the release key hole.

Figure 10:
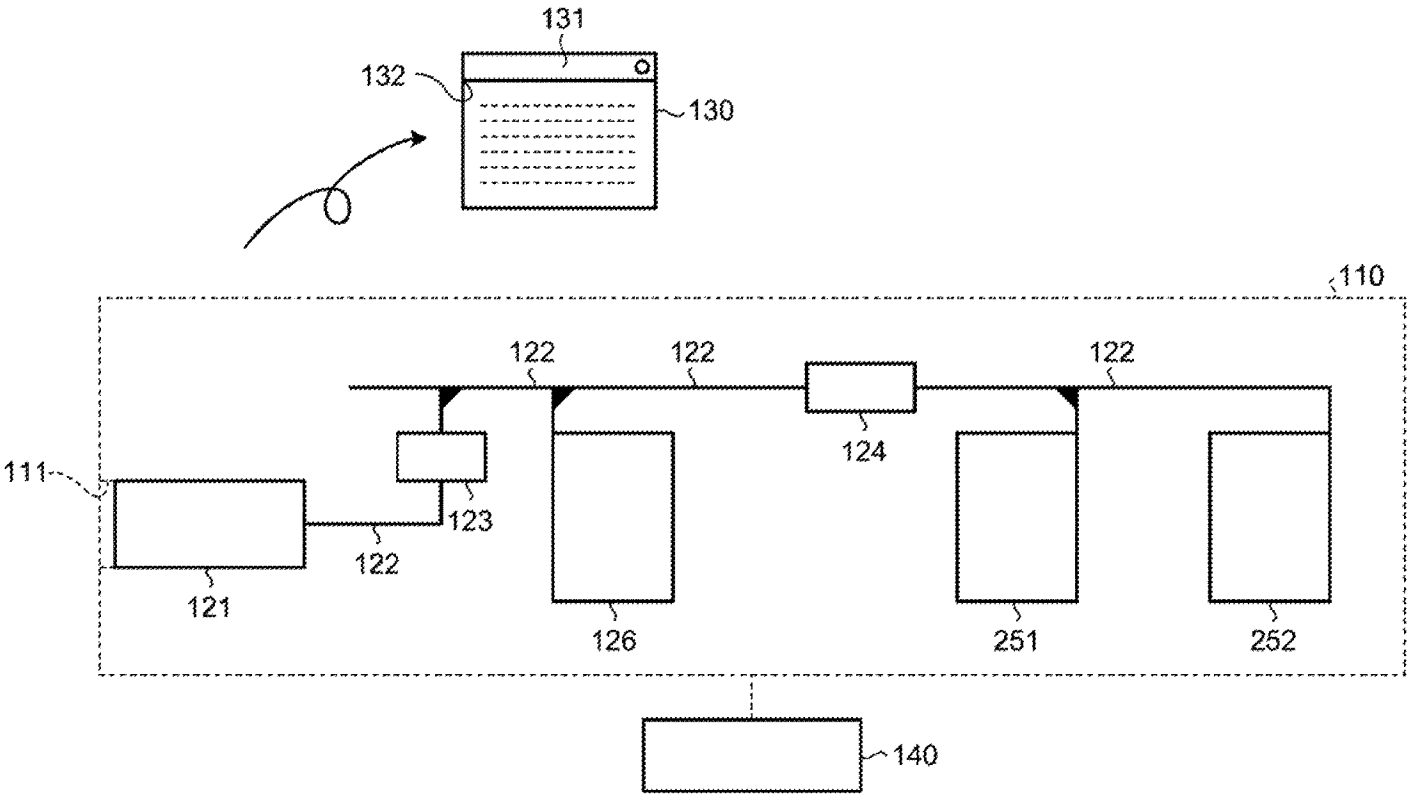
FIG. 10 is a descriptive view for explaining the case in which the bill processing device illustrated in FIG. 6 performs the collection operation.

After the bills in all of the storage boxes 125 are stored in the dispensing collection box 130, as illustrated in FIG. 10, the bill processing device allows the dispensing collection box 130 to be detached front the device main body 110 by insertion and operation of the takeout key into the takeout key hole. The dispensing collection box 130 detached in this manner is kept in a safe that the manager manages.

Figure 11:
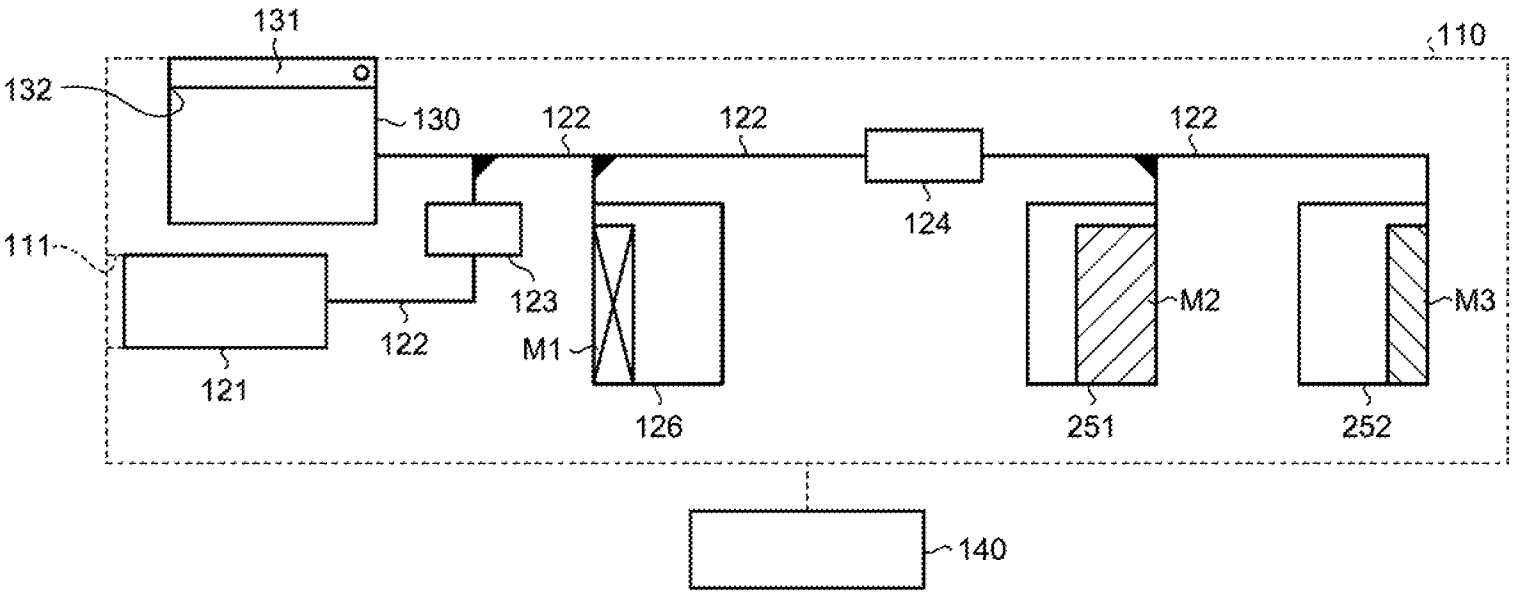
FIG. 11 is a descriptive view for explaining the case in which the bill processing device illustrated in FIG. 6 performs an examination operation.

Finally, an examination operation is described. Hereinafter, as illustrated in FIG. 11, it is assumed that five thousand-yen bills M1 are stored in the examination box 126, one thousand-yen bills M2 are stored in the front-side storage box 251, and mixed bills (ten thousand-yen bills and two thousand-yen bills) M3 are stored in the back-side storage box 252 for description.

Figure 12:
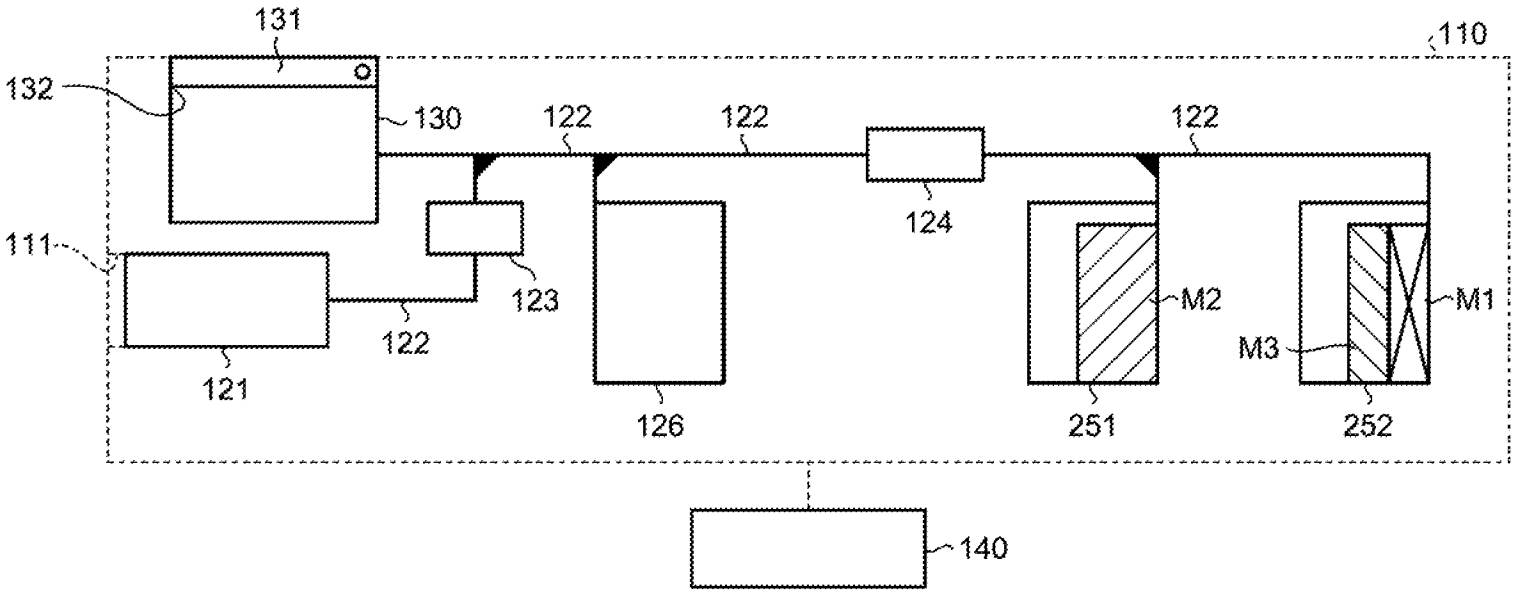
FIG. 12 is a descriptive view for explaining the case in which the bill processing device illustrated in FIG. 6 performs the examination operation.

When the manager performs an input operation on the input unit (not illustrated) for the manager to give an examination instruction, as illustrated in FIG. 12, the bill processing device feeds out the five thousand-yen bills M1 stored in the examination box 126 to the conveyance path 122 and conveys them to the back side through the conveyance path 122 by the controller 140 driving the conveyance unit, and stores them in the back-side storage box 252.

Figure 13:
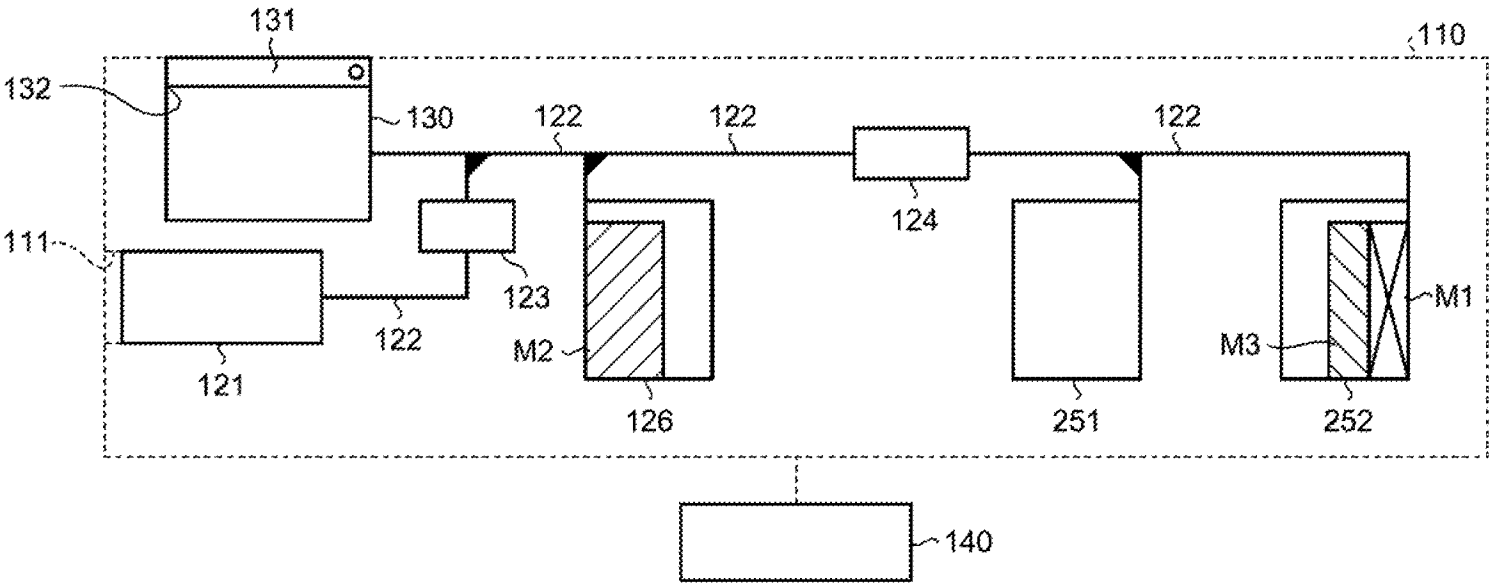
FIG. 13 is a descriptive view for explaining the case in which the bill processing device illustrated in FIG. 6 performs the examination operation.

After the five thousand-yen bills M1 are stored in the back-side storage box 252, the bill processing device feeds out the one thousand-yen bills M2 stored in the front-side storage box 251 to the conveyance path 122 and conveys them to the front side through the conveyance path 122 by the controller 140 driving the conveyance unit, determines, by the determination unit 124, the denomination and the number of one thousand-yen bills M2 being conveyed during the conveyance, and stores the determined one thousand-yen bills M2 in the examination box 126, as illustrated in FIG. 13. In this manner, the number of one thousand-yen bills M2 can be fixed by being counted.

Figure 14:
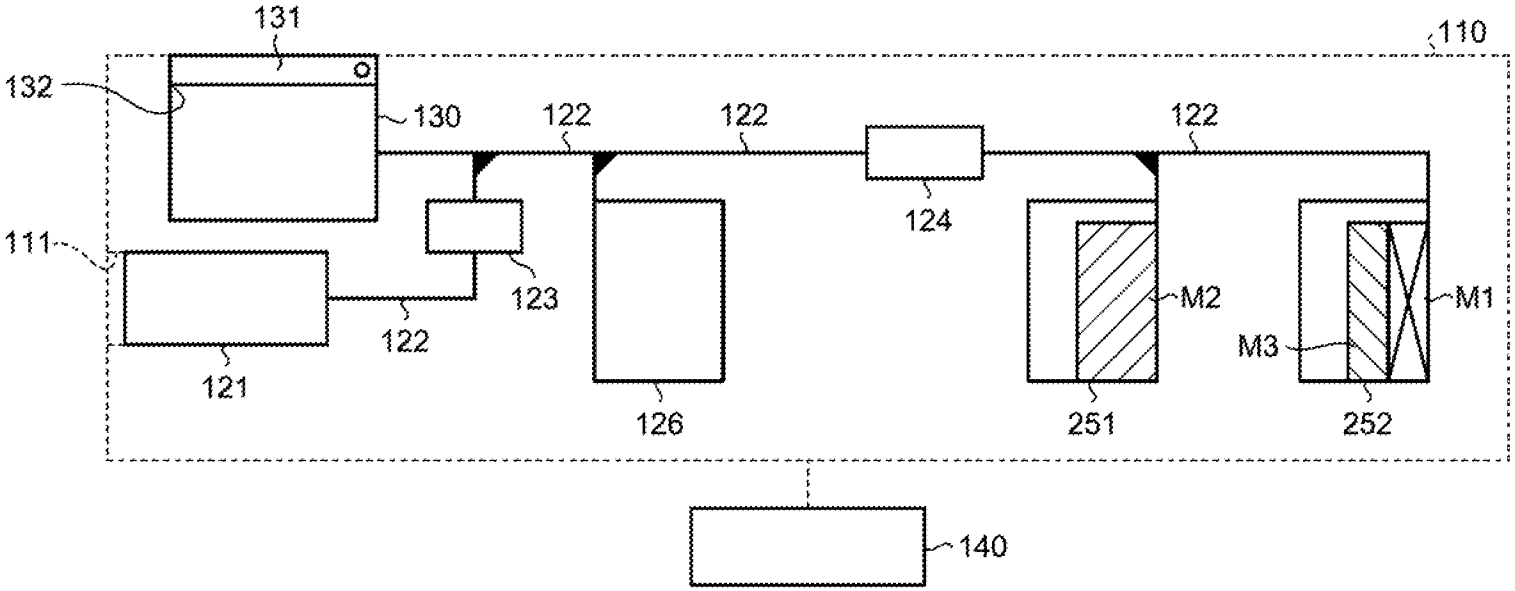
FIG. 14 is a descriptive view for explaining the case in which the bill processing device illustrated in FIG. 6 performs the examination operation.

After the one thousand-yen bills M2 are stored in the examination box 126, the bill processing device feeds out the one thousand-yen bills M2 to the conveyance path 122 from the examination box 126 and conveys them to the back side by the controller 140 driving the conveyance unit, and stores them, back in the front-side storage box 251, as illustrated in FIG. 14.

Figure 15:
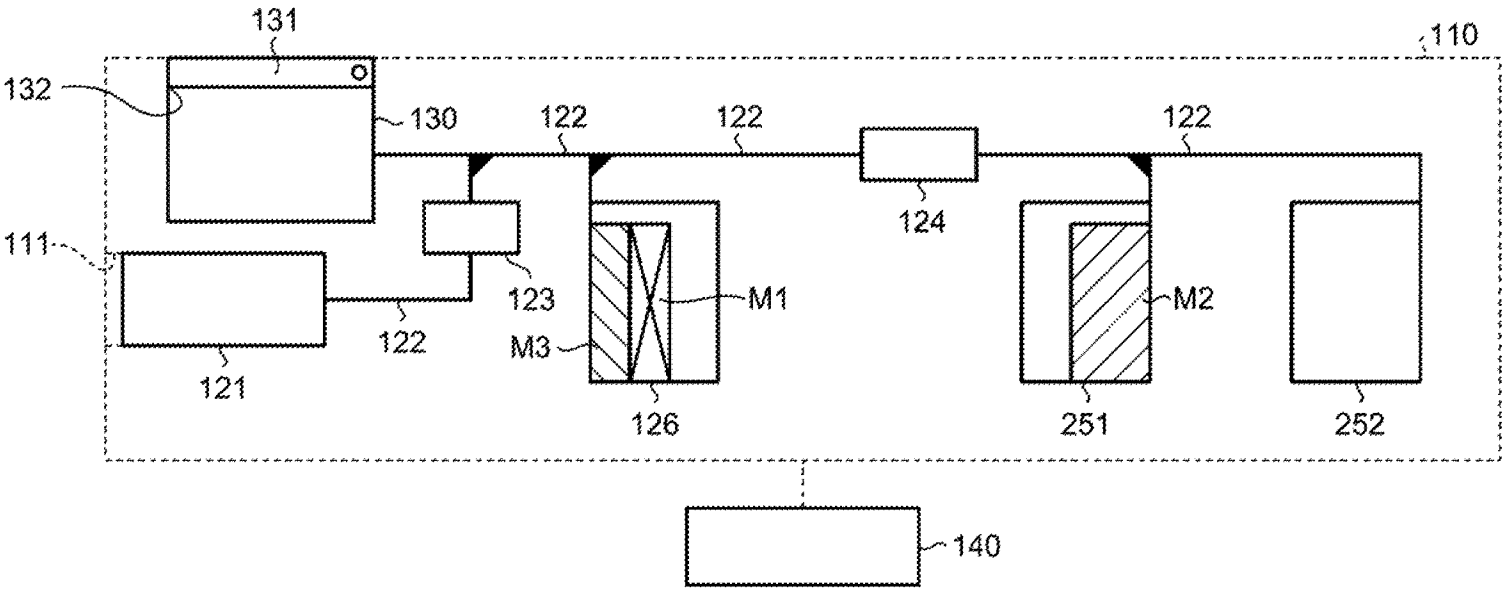
FIG. 15 is a descriptive view for explaining the case in which the bill processing device illustrated in FIG. 6 performs the examination operation.

The bill processing device feeds out the five thousand-yen bills M1 and the mixed bills M3 stored in the back-side storage box 252 to the conveyance path 122 and conveys them to the front side through the conveyance path 122 by the controller 140 driving the conveyance unit, determines, by the determination unit 124, the denominations and the numbers of five thousand-yen bills M1 and mixed bills M3 being conveyed during the conveyance, and stores the determined five thousand-yen bills M1 and mixed bills M3 in the examination box 126 as illustrated in FIG. 15, in this manner, the numbers of five thousand-yen bills M1 and mixed bills M3 can be fixed by being counted.

Figure 16:
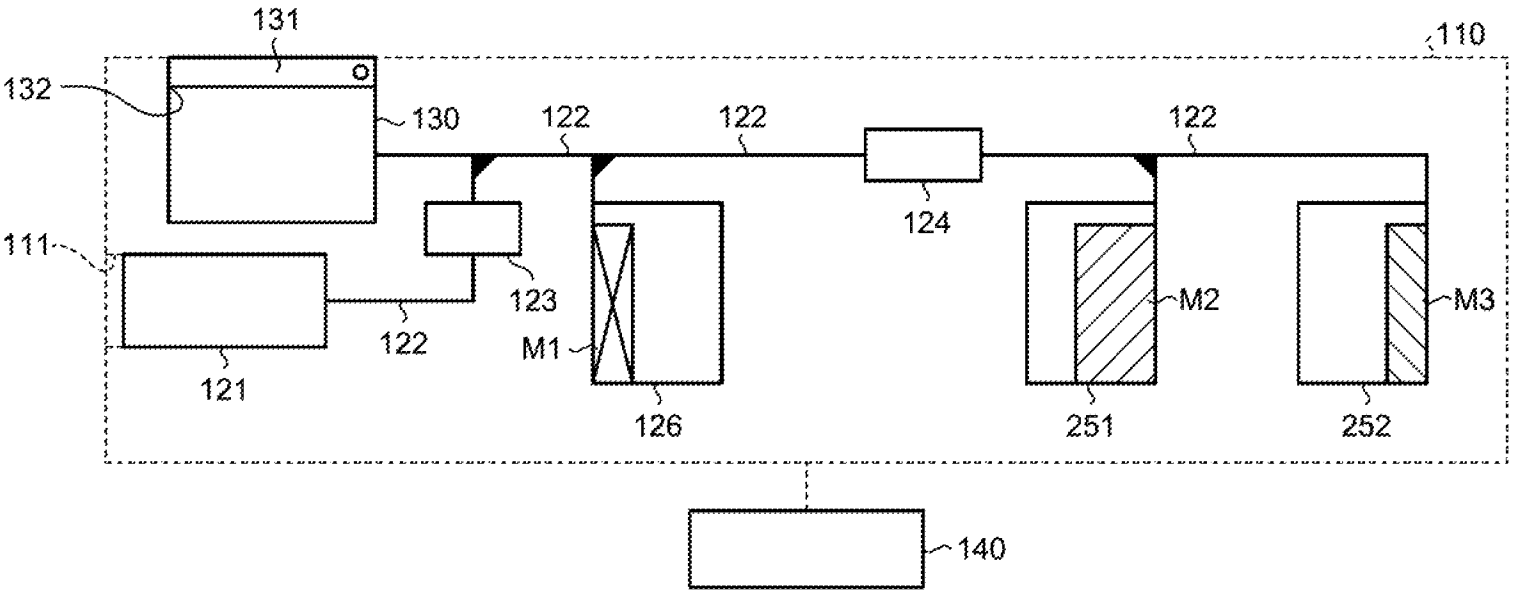
FIG. 16 is a descriptive view for explaining the case in which the bill processing device illustrated in FIG. 6 performs the examination operation.

After the five thousand-yen bills M1 and the mixed bills M3 are stored in the examination box 126, the bill processing device feeds out the mixed bills M3 to the conveyance path 122 from the examination box 126 and conveys them to the back side by the controller 140 driving the conveyance unit, and stores them back in the back-side storage box 252, as illustrated in FIG. 16. The examination operation is thus finished.

As described, above, with the bill processing device in the embodiment, the controller 140 stores, in the examination box 126, the five thousand-yen bills among the bills input into the reception unit 121. When the dispensing instruction to dispense the five thousand-yen bill is given, the controller 140 conveys it to the dispensing collection box 130 from the examination box 126 to dispense it. The five thousand-yen bill stored in the mix box therefore needs not to be separated from the ten thousand-yen bills and the like to be dispensed unlike the conventional technique, thereby reducing a time required for dispensing a specific denomination of bill (five thousand-yen bill).

With the above-mentioned bill processing device, when the examination instruction is given, the controller 140 stores the five thousand-yen bills stored in the examination box 126 in the back-side storage box 252 storing therein a plurality of denominations of bills for examination, thereby preventing a time required for examination from being increased.

With the above-mentioned bill processing device, when the collection instruction is given, the dispensing collection box 130 collects the bills stored in the respective storage boxes 125 and the examination box 126. That is, the dispensing collection box 130 also has a function of a conventional collection box. An installation space for the collection box can be therefore reduced, thereby reducing the entire device in size.

With the above-mentioned bill processing device, the dispensing collection box 130 is provided in the device main body 110 in a detachable manner. The dispensing collection box 130 itself can therefore be kept in a predetermined safe or the like by detaching the dispensing collection box 130 from the device main body 110 after storing, in the dispensing collection box 130, the bills stored in the respective storage boxes 125 and the examination box 126. This configuration eliminates the necessity to take out the bills from the dispensing collection box 130, thereby improving security.

The preferred second embodiment of the disclosure has been described above. The disclosure is not however limited thereto and various changes can be made.

Although the five thousand-yen bill is employed as an example of the specific denomination of bill in the above-mentioned second embodiment, the specific domination of bill may not be the five thousand-yen bill in the disclosure.

In the above-mentioned second embodiment, the examination box 126 may be use as back-side storage box 252 that is the mix box, whereas the back-side storage box 252 may be used as the examination box 126. In this case, only the five thousand-yen bills as the second denomination bills are stored in the back-side storage box 252 in the reception.

According to some embodiments, bills to be used as change can be stored for respective denominations, thereby rapidly dispensing change bills.

Although the disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A bill processing device comprising:

a first denomination bill storage box configured to store therein first denomination bills to be used as change;

a mix box configured to store therein a plurality of denominations of bills other than the first denomination bills in a mixed manner;

an examination box configured to function as a temporary storage box in examination of recounting numbers of bills stored in the first denomination bill storage box and the mix box, the bill processing device being configured to perform reception and dispensing processing of bills, wherein only second denomination bills to be used as change are stored in the examination box or the mix box in the reception or after the examination, and the second denomination bills stored in the examination box or the mix box are dispensed when a dispensing instruction to dispense the second denomination bills is given; and an examination controller configured to perform first examination processing to examine the first denomination bills and second examination processing to store only the second denomination bills in the mix box after the second examination processing, wherein the second examination processing includes conveying, to the examination box, the bills stored in the mix box while counting the number of the bills stored in the mix box to temporarily store the bills in the examination box;

returning, to the mix box, the second denomination bills to be used as the change among the bills temporarily stored in the examination box, conveying and temporarily storing, to and in the first denomination bill storage box, bills other than the second denomination bills among the bills temporarily stored in the examination box, and conveying and storing, to and in the examination box, bills other than the first denomination bills that are stored in the first denomination bill storage box.

2. The bill processing device according to claim 1, wherein the first examination processing includes:

emptying the examination box;

conveying, to the emptied examination box, the first denomination bills stored in the first denomination bill storage box while counting the number of the first denomination bills stored in the first denomination bill storage box to temporarily store the first denomination bills in the examination box; and returning, to the first denomination bill storage box, the first denomination bills temporarily stored in the examination box.

3. The bill processing device according to claim 2, wherein the first examination processing further includes:

temporarily storing, in the mix box, a first predetermined number of first denomination bills at a storage back row side among the counted number of the first denomination bills temporarily stored in the examination box;

storing, in the first denomination bill storage box, remaining first denomination bills in the examination box; and then storing, in the first denomination bill storage box, the first denomination bills temporarily stored in the mix box.

4. The bill processing device according to claim 2, wherein the second examination processing further includes:

temporarily storing, in the first denomination bill storage box, bills containing a second predetermined number of second denomination bills at a storage back row side among the counted number of second denomination bills temporarily stored in the examination box;

storing, in the mix box, remaining second denomination bills in the examination box;

then storing, in the mix box, the second denomination bills temporarily stored in the first denomination bill storage box; and storing, in the examination box, bills other than the second denomination bills in the first denomination bill storage box.

5. The bill processing device according to claim 2, wherein the second examination processing further includes:

returning, to the mix box, a third denomination bill to be used as change among bills stored in the examination box;

temporarily storing, in the first denomination bill storage box, bills other than the third denomination bill in the examination box; and conveying and storing, to and in the examination box, bills other than the first denomination bills that are stored in the first denomination bill storage box.

6. The bill processing device according to claim 1, wherein only the second denomination bills to be used as the change are stored in the examination box or the mix box in the reception, and the second denomination bills stored in the examination box or the mix box are dispensed when a dispensing instruction to dispense the second denomination bills is given.

7. The bill processing device according to claim 1, wherein the mix box is used as the examination box, whereas the examination box is used as the mix box.

* * * * *